United States Patent [19]

Vandermarliere

[11] Patent Number: 4,807,504

[45] Date of Patent: Feb. 28, 1989

[54] METHOD AND DEVICE FOR PREPARING A STACK OF FABRIC PANELS FOR SUBSEQUENT CUTTING

[75] Inventor: Marc Vandermarliere, Troyes, France

[73] Assignee: Institut Textile de France, Boulogne Billancourt, France

[21] Appl. No.: 89,672

[22] Filed: Aug. 26, 1987

[30] Foreign Application Priority Data

Sep. 8, 1986 [FR] France ..... 86 12555

[51] Int. Cl.[4] ..... B26D 7/14; B26F 1/24

[52] U.S. Cl. ..... 83/22; 83/30; 83/169; 83/925 CC; 83/451

[58] Field of Search ..... 83/925 CC, 451, 22, 83/30, 169; 269/21, 22, 54.4, 236

[56] References Cited

U.S. PATENT DOCUMENTS

| | | | |
|---|---|---|---|
| 1,475,278 | 11/1923 | Cole | 269/236 |
| 2,852,463 | 9/1958 | Gutzmer | 269/22 |
| 3,695,134 | 10/1972 | Hardwick | 83/451 |
| 3,765,289 | 10/1973 | Gerber et al. | 83/925 CC |
| 4,312,254 | 1/1982 | Pearl | 83/925 CC |
| 4,461,946 | 7/1984 | Kratschmer | 269/236 |
| 4,494,433 | 1/1985 | Gerber | 83/925 CC |
| 4,528,878 | 7/1985 | Gerber | 83/925 CC |

FOREIGN PATENT DOCUMENTS

| | | |
|---|---|---|
| 849666 | 4/1977 | Belgium . |
| 859478 | 2/1978 | Belgium . |
| 1475071 | 3/1966 | France . |
| 2030792 | 12/1969 | France . |
| 2444109 | 7/1980 | France . |
| 2040330 | 8/1980 | United Kingdom . |

*Primary Examiner*—Frank T. Yost
*Assistant Examiner*—Scott A. Smith
*Attorney, Agent, or Firm*—Shenier & O'Connor

[57] ABSTRACT

The invention relates to the preparation of a stack of knitted fabric panels for subsequent cutting. It consists in spreading the knitted panels under extension over the needles of a needle table, covering the formed stack over with a sheet of material impervious to air, creating a reduced pressure inside the stack by sucking in the air contained between the table and the sheet, retracting the needles from the stack and proceeding to the cutting while keeping up the suction throughout the cutting operation.

The needle table comprises a table top perforated with holes, a movable support on which are fixed the needles and a tight box containing the movable support and equipped with suction means.

6 Claims, 4 Drawing Sheets

METHOD AND DEVICE FOR PREPARING A STACK OF FABRIC PANELS FOR SUBSEQUENT CUTTING

FIELD OF THE INVENTION

The present invention relates to the stacking, for cutting purposes, of panels of knitted fabrics, used for making clothing, such as pull-overs, dresses or similar garments.

BACKGROUND OF THE INVENTION

Needle tables are conventionally used for preparing the elements to be assembled for the production of knitted fabric articles. The knitted panels are stretched and stacked over the needles which are placed on the periphery of the panel and in specific points of the pattern. Such stacking over needles makes it possible to stretch the panels and to hold them so throughout the cutting operation. Thus, each element of the garment is cut from a web of knitted fabric in which the stitch density reaches maximum homogeneousness.

The use of needle tables, however, is not completely satisfactory. Indeed, if the stack is cut with an electric cutter, the needles have to be retracted from the stack as the cutter progresses into it ; such removal causes a deformation of the knitted fabric especially at the level of the welts which tend to shrink up as soon as the needles are removed ; a staggering of the different layers of the stack may also occur, particularly on the edge of the stack when the cutting is performed along selvedges: the cutter then tends to side-slip when there is five to ten millimeters between the cutting line and the selvedge and the resulting cut is irregular.

To reduce these irregularities to a minimum, it is normal to place the knitted fabric over the needles with little only or even no extension, although this may be detrimental to the subsequent preparation for cutting.

SUMMARY OF THE INVENTION

Now an improvement has been found, and this is the object of the present invention, in the preparation of stacks made on needle tables for cutting purposes, which improvement makes it possible to eliminate the aforesaid drawbacks, and consists in spreading the knitted panels under extension over the needles of a needle table, covering the formed stack over with a sheet of material impervious to air, creating a depression inside the stack by sucking in the air contained between the table and the sheet, retracting the needles from the stack and proceeding to the cutting while keeping up the suction throughout the cutting operation.

Quite unexpectedly, the reduced pressure created inside the stack locks the knitted panels in the extended condition in which they were placed during the stacking operation, keeping them so throughout the cutting operation. The creation of a reduced pressure is also currently used for cutting stacks of woven fabrics, which require no extending of the corresponding panels. Therefore, there are two different techniques for cutting stacks of fabric panels, depending on the articles : the needle technique for knitted fabric panels and the reduced pressure technique for woven fabric panels. These two techniques are respectively illustrated in British Patent No. 2 040 330 and in French Patent No. 2 444 109.

The advantage of the invention is to combine the two techniques once it has been checked that the reduced pressure was sufficient to keep all the panels in the stack in a stretched condition without any shrinkage of the knitting after the retraction of the needles. The needle technique is used for preparing the stack in an extended condition; the reduced pressure technique being used for locking the stack in position. The combination of the two techniques, according to the invention, leads to a result which heretofore had never been obtained , i.e. the cutting of a stack of extended knitted panels without using needles.

Another object of the invention is to propose an improved needle table especially designed for carrying out the aforesaid method. Said needle table comprises, in known manner, a vertically movable support on which are fixed the needles and a perforated table top through the holes of which the needles can slide. In characteristic manner, said table comprises, under the lower surface of the table top, a tight box member containing the movable support, and suction means capable of creating a reduced pressure inside said box and through the perforations of the table top.

Preferably, the needles are removable and held while they are retracted from the stack by temporary locking means. The advantage of this particular disposition is that it makes it possible to alter the number of needles used and their position, when a stack is changed for example, by withdrawing some of the needles fitting loosely inside the perforations of the table top, while permitting the retraction of the needles which then are locked in position, by vertical displacement of the movable support.

According to a particularly advantageous embodiment of the invention, the means for temporarily locking a needle comprise, under the corresponding hole formed in the table top:

a U-shaped section, fixed on the upper face of the movable support in such a way that the position of the external generatrix of the hole corresponds to the inner side of the U-section, and a flexible tube with extensible wall placed at the bottom of the U-section and connected with a source of compressed air.

The needle, slipped in the hole, fits between the inner side of the U-section and the flexible tube. Temporary locking of the needle is achieved by locking the needle between said side of the U-section and the wall of the tube inflated under the action of the compressed air.

Advantageously, at right angles with the needle, the flexible tube is protected by a strip of a material showing good friction strength, this in order to prevent the tube wall from becoming damaged by repeated introductions and withdrawals of the needle between the U-section and the tube.

Other needles temporary locking means can also be used, although the above mentioned advantageous means has been found to be simple to produce and efficient; it permits a collective locking of all the needles with only one tube, or of portions of needles with a plurality of tubes.

The mechanical means for locking a needle will comprise, for example, under the corresponding hole made in the table top:

a bar, fixed on the upper face of the movable support, and a cylinder, fast with said movable support via the bearings keeping its axis in off-centered position, said bar and said cylinder being parallel and situated on either side of the external generatrix of the hole;

a lever, mounted on the end of the cylinder axis, and connected to a jack-actuated rod, so that, by the action of the jack, the rod moving the lever causes the cylinder axis to turn and, as said axis is off-centered the cylinder turns and applies the needle against the bar.

BRIEF DESCRIPTION OF THE DRAWINGS.

The invention will be more readily understood on reading the following description with reference to the accompanying drawings, in which.

DETAILED DESCRIPTION OF THE INVENTION

Figure 1:
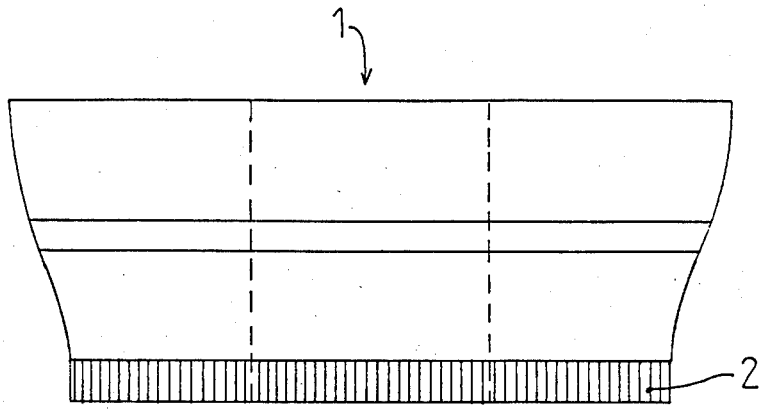
FIG. 1 illustrates a knitted panel released from the knitting machine.

Let us take as an example, a knitted panel 1, released from a flat knitting machine, the base of which panel presents a welt 2 The interlacing of yarns used for producing the welt is designed to tighten the base of the panel. The knitting is so carried out that several elements of the article to be produced are obtained in the width of the panel, the number of said elements varying as a function of the patterns and sizes (in the case illustrated in FIG. 1, it is three back elements).

The panel 1 is stretched and fastened to the table top 3 of the needle table 4 by means of the needles 5 provided on the periphery of the panel 1 and in specific points of the pattern. A plurality of such panels are stacked one on top of the other, as in 6.

The needle table 4 comprises a table top 3, a movable support 7 and the suction box 8. The table top 3 is provided with holes 9 which are regularly spaced, such as according to the checquered pattern illustrated in FIG. 4. The interval between each hole is about 2 cm. Each hole 9 has a diameter sufficient to allow the free sliding of a needle 5.

The movable support 7 comprises a plate 10 on which are fixed the U-sections 11 used for locking the needles 5, as well as the means for vertically moving the plate 10. Said means consist in an endless screw 12 fast with the frame 13 of the table 4, and driven in rotation by a motor 14. Two nuts 15 held by two blocks 16 are mounted on the ends of the screw 12; said nuts are secured on the lower end of an arm 17 pivotally mounted on a pin 18. The upper end of said arm 17 supports a runner 19 rolling inside a sliding bed 20. The plate 10 is guided transversely and longitudinally inside the frame 13 by wheels 21.

The U-sections 11 are fixed on plate 10 in such a way that the external generatrix 9' of a hole 9 corresponds to the inner side 11' of a U-section 11. As illustrated in FIG. 5, the same U-section is placed under two adjacent holes, this permitting simultaneous locking of two needles.

Figure 4:
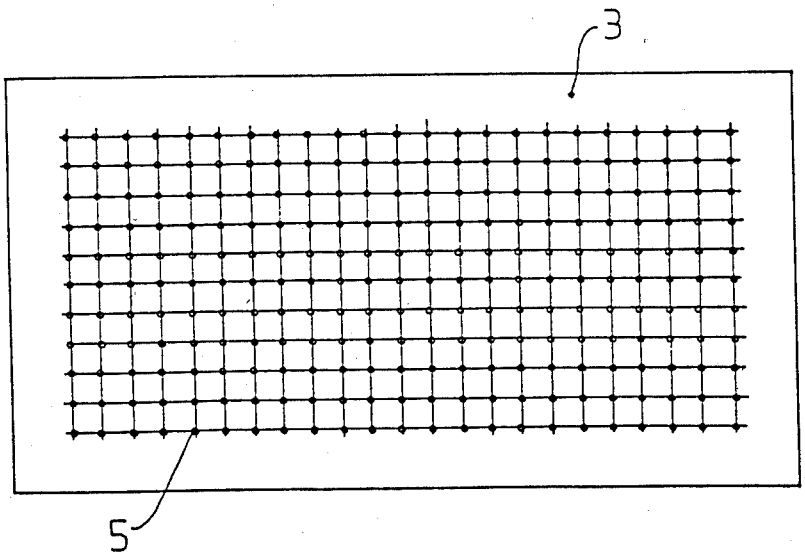
FIG. 4 is a diagrammatical plain view of the needle table.
Figure 5A:
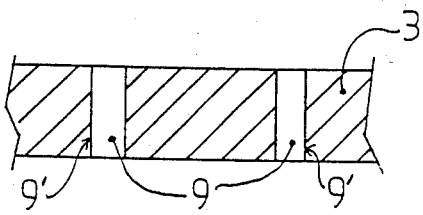
FIG. 5*a*, 5*b*, and 5*c* diagrammatical cross-sections of pneumatical locking means, without needle (5*a*), with a non-locked needle (5*b*), and with a locked needle (5*c*)
Figure 5B:
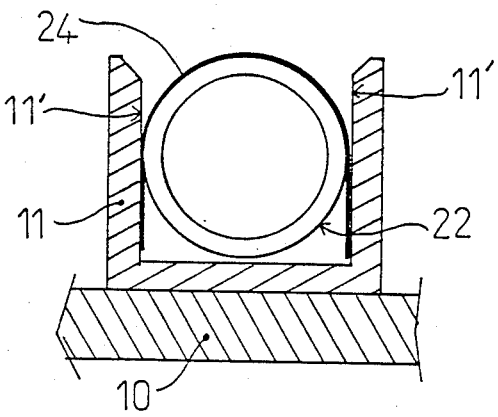
Figure 5B:
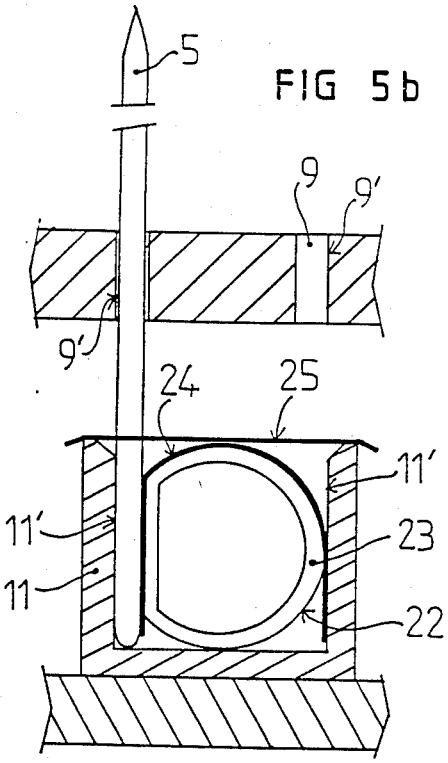
Figure 5C:
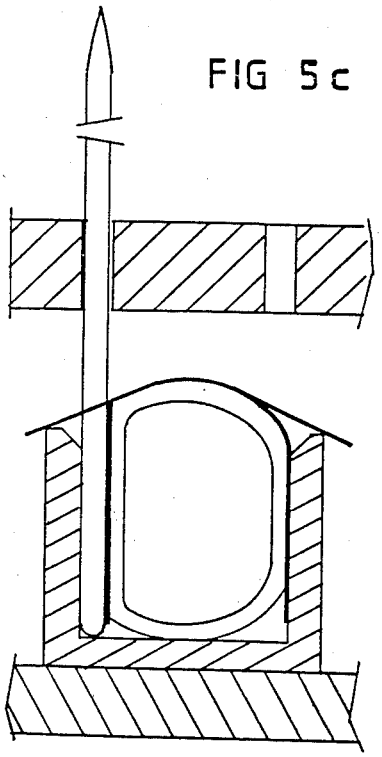

The flexible tube 22 is placed inside a U-section 11. One end of said tube 22 is closed while the other end is connected to a supply of compressed air. The wall 23 of the tube 22 is extensible. A protective strip 24, U-bent lengthwise, is pinched between the tube 22 and the U-section 11. Said strip 24 is constituted by a piece of flat belt. There are as many U-sections 11 on plate 10 as there are lines of holes (FIG. 4). A strap 25 is stretched across and above the U-sections 11, one strap every twenty centimeters, by means of fasteners fixed on plate 10 between each U-section. The ends of each strap 25 are pinched under the end sections. The width of the strap 25 is such that said strap can pass between two lines of needles.

The suction box 8 is constituted by the walls closing laterally the four sides of the frame 13, of the bottom 26 and of the table top 3, the whole forming a tight box containing the movable support 4 and the needles locking means. The turbine 27, secured on the bottom 26, creates a reduced pressure inside the box 8.

In order to prepare a stack for cutting, table 4 works as follows. The movable plate 10 being in high position, a set number of needles are placed in the holes 9 of the table top 3 in the right disposition corresponding to the size of the panels and to the design of the pattern. Each needle 5 is introduced in the housing provided between section 11 and the outer wall of the strip 24 protecting the tube 22. Compressed air is sent through all the tubes 22, thereby increasing the diameter of said tubes (FIGS. 5*b* and 5*c*), which presses the needle 5 against the inner side 11' of the U-section. All the needles 5 are thus locked simultaneously. The tape 24 and the strap 25 are provided for holding the tube 22 inside the section 11 and for preventing it from deforming and from being damaged by the passage of the needles 5.

Figure 2:
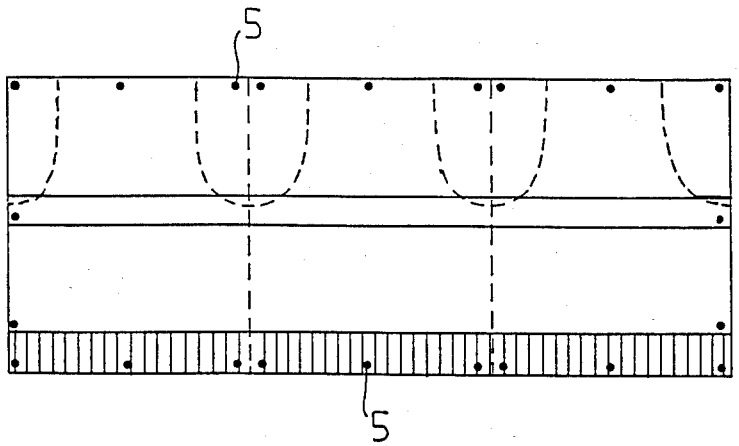
FIG. 2 illustrates the same panel fixed on the needle table for cutting.
Figure 3:
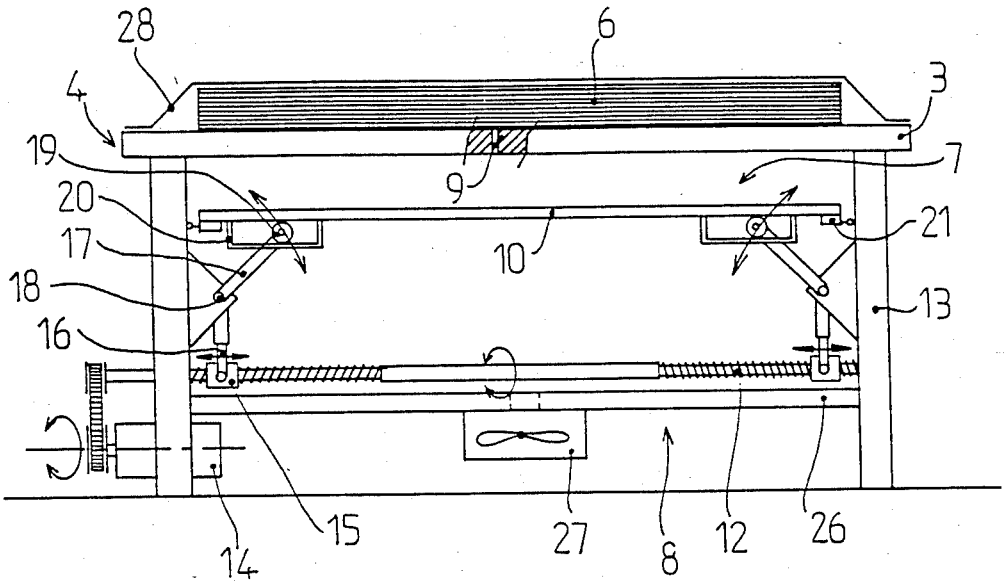
FIG. 3 is a diagrammatical cross-section of the needle table according to the invention.

The motor 14 is started so that the nuts 15 move on the endless screw 12 towards the edges of the frame 13, carrying downwardly the lever 17 which, being associated to the displacement of the runner 19 inside the sliding bed 20, causes the lowering of the plate 10. Then the motor is stopped when the needles project by two or three centimeters above the table top 3. The operator can then start the stacking operation, fixing each panel 1 under extension on the needles 5 as illustrated in FIG. 2. During the stacking, when the needle height is no longer sufficient, plate 10 is raised by a new rotation of the motor 14 in reverse direction.

When the stack 6 is completed, it is covered over with a plastic film 28 impervious to air, in such a way that said film projects beyond each side of the stack 6. Suction turbine 27 is then started. The reduced pressure created inside the tight box 8 spreads through the holes 9 into the enclosure constituted by the space between the film 28 and the table top 3. Said reduced pressure applies the film 28 on the stack 6 and compresses the latter.

The motor 14 is actuated in reverse direction, this lowering the plate 10 and, the needles being locked between the U-sections 11 and the tube 22 and retracting the needles 5. Cutting may then begin, the turbine 27 being operated throughout the cutting operation. The stack is thus compressed and held in stretched condition under the effect of the suction, and it can be cut without needles.

Once the cutting is completed, the turbine 27 is stopped and the stacks of pieces cut for example as illustrated in dotted lines in FIG. 2, are removed. The table 4 is then ready to start another cycle.

Altering or complete changing of the position of the needle is achieved by raising up the movable plate 10 and unlocking the needles by cutting off the compressed air supply to the tubes 22.

Figure 6:
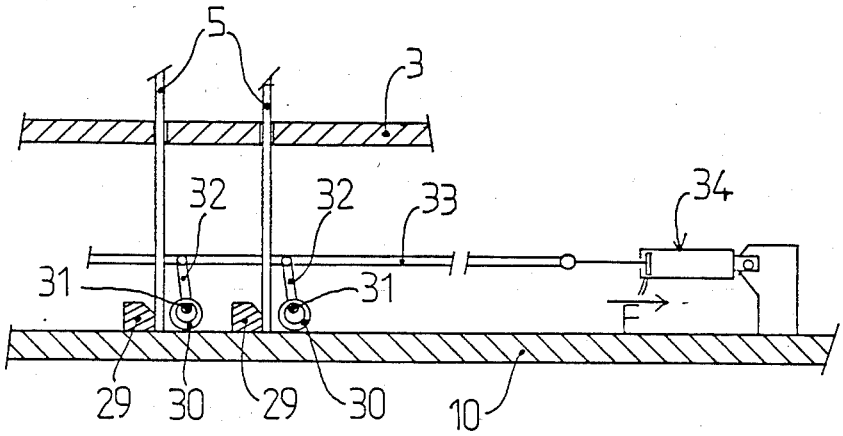
FIG. 6 is a diagrammatical cross-section of a mechanical locking means.

The invention is in no way limited to the description, given hereinabove, of a preferred embodiment. On the contrary, other means of locking the needles can be used, such as for example purely mechanical means, as illustrated in FIG. 6. A bar 29 and a cylinder 30 are fixed on the plate 10 in parallel to and on either side of each line of needles. The bar is fixed on the upper face of the plate 10 and the cylinder 30 is fast with plate 10 owing to two bearings which hold the ends of its rotating pin 31, which pin is off-centered. A lever 32 is mounted on pin 31, said lever being in turn connected to a rod 33. There is only one such rod 33 for all the cylinders;said rod is actuated by a jack 34. These mechanical means work as follows. In the normal position which corresponds to the introduction of the needles (FIG. 6) the bar 29 and the corresponding cylinder 30 are moved apart, leaving a gap between them for receiving the lower part of the needle 5. For locking the needles, the jack is actuated, the rod 33 then moves in the direction of arrow F, the lever 32 causes pin 31 to turn about its own axis thereby causing the pivoting movement of cylinder 30 which latter, pin 31 being off-centered, is applied against the needle wedged between cylinder 30 and bar 29.

For a table top of which the perforated surface is 100 cm×200 cm, the reduced pressure created by the turbine was 300 mm of water at a rate of 300 m3/hour. The table top contains 5151 perforations of 2 mm diameter.

What is claimed is:

1. A method for preparing stacks of knitted fabric panels of subsequent cutting of the type in which the knitted panels are placed under extension in a stack over the needles of a needle table, said method comprising the steps of:

(a) covering the formed stack with a sheet of material impervious to air, (b) compressing the stack by suction which reduces the pressure of the air contained between the table top and the sheet, (c) retracting in needles from the stack, and (d) cutting the stack of knitted fabric panels while maintaining said suction throughout said stack.

2. Needle table for carrying out the method of claim 1, of the type comprising a vertically movable support on which are fixed the needles and a table top perforated with holes through which the needles can slide, wherein said table further comprises, under the lower surface of the table top, a suction box containing the movable support and suction means for creating a reduced pressure inside said box and through the holes formed in the table top after said panels are placed under extension in said stack over said needles, wherein said suction is maintained after withdrawal of said needles from said stack.

3. Needle table as claimed in claim 2, wherein the needles are removable and held during their retraction from the stack by temporary locking means.

4. Needle table as claimed in claim 3, wherein the means for temporarily locking a needle comprise, under the corresponding hole formed in the table top:

a U-shaped section, fixed on the upper face of the movable support in such a way that the position of the external generatrix of the hole corresponds to the inner side of the U-section, and a flexible expandable tube placed at the bottom of the U-section and connected with a source of compressed air.

5. Needle table as claimed in claim 3, wherein the means for temporarily locking a needle comprise, under the corresponding hole formed in the table top:

a bar, fixed on the upper face of the movable support, and a cylinder, fast with said movable support via bearings keeping its axis in off-centered position, said bar and said cylinder being parallel and situated on either side of the external generatrix of the hole;

a lever, mounted on the end of the cylinder axis, and connected to a jack-actuated rod, so that, by the action of the jack, the rod moving the lever causes the cylinder axis to turn and, as said axis is off-centered, the cylinder turns and urges the needle against the bar.

6. A needle table for preparing stacks of knitted fabric panels for subsequent cutting including in combination:

(a) a table top perforated with a plurality of holes, (b) a suction box below said table top, (c) a support, (d) a plurality of needles carried by said support, (e) means mounting said support in said suction box for movement between an upper position at which said needles extend through said holes and through a stack of fabric panels on said table and a lower position at which said needles are withdrawn from said stack and (f) means for creating a reduced pressure within said suction box and through said holes and within said stack in the upper position of said support to compress said stack and for maintaining said reduced pressure after withdrawal of said needles from said stack upon movement of said support to said lower position.

* * * * *